US005461810A

United States Patent [19]

Goserud

[11] Patent Number: 5,461,810

[45] Date of Patent: Oct. 31, 1995

[54] SELF-FRAMING DISPLAY HOLDER FOR FLAT OBJECTS

[76] Inventor: J. Thomas Goserud, 13818 Sutters Mill Rd., Midlothian, Va. 23112

[21] Appl. No.: 251,309

[22] Filed: May 31, 1994

[51] Int. Cl.[6] ..... G09F 3/18

[52] U.S. Cl. ..... 40/661; 40/159; 40/158.1

[58] Field of Search ..... 40/155, 159, 661, 40/158.1, 405, 537, 649

[56] References Cited

U.S. PATENT DOCUMENTS

| | | | |
|---|---|---|---|
| 3,940,778 | 2/1976 | Craig et al. | 40/159 X |
| 4,916,838 | 4/1990 | Holson | 40/159 |
| 4,979,619 | 12/1990 | Hager | 40/156 X |
| 5,040,671 | 8/1991 | Hager | 40/661 X |
| 5,245,775 | 9/1993 | Goserud | 40/642 |

*Primary Examiner*—Brian K. Green
*Attorney, Agent, or Firm*—Norman B. Rainer

[57] ABSTRACT

A holder for protectively displaying flat objects includes a jacket formed from two identical rectangular sheets of semi-rigid transparent plastic disposed one atop the other and sealed together along three edges by bonding to intervening spacer strips. The unsealed fourth edges define an entrance opening to an enclosure bounded by the sheets and spacer strips. The sheets are bowed into contact upon a center axis. A pouch-like retainer member adapted to confine a flat object, and having a centered display aperture, is dimensioned to slideably insert into the jacket. The force of interaction of the bowed sheets is sufficiently strong, and the weight of the holder is sufficiently light to enable the holder to be suspended by the retainer member.

10 Claims, 2 Drawing Sheets

SELF-FRAMING DISPLAY HOLDER FOR FLAT OBJECTS

BACKGROUND OF THE INVENTION

1. Field of the Invention

This invention concerns a holder for protectively displaying flat objects, and more particularly relates to a light weight inexpensive holder which permits rapid securement and bordering of visually distinctive flat objects.

2. Description of the Prior Art

It is often sought to protectively display flat visually distinctive materials such as photographs, drawings, collectible sports cards, currency and postage stamps. It is further desirable to utilize a surrounding border that enhances the appearance of the object.

U.S. Pat. No. 5,245,775 to Goserud discloses a protective holder for displaying both sides of flat rectangular objects such as sports cards. The Goserud holder is comprised of a jacket formed from two facing rectangular sheets of transparent plastic interbonded along three edges. A framing insert member, having a thickness which perfectly fills the space between the facing sheets, has a centered rectangular aperture of a size to exactly receive the sports card.

By virtue of such construction, both surfaces of the sports card are substantially coplanar with the opposed surfaces of the framing insert member, and the edges of the sports card lie in abutment with the edges defining the centered aperture. The Goserud holder, although having several specialized features, requires that the aperture of the insert member exactly matches the rectangular perimeter of the sports card.

U.S. Pat. No. 5,040,671 to Hager discloses a transparent plastic display case for the long term protective storage of valuable flat items such as postage stamps. The case is fabricated of facing rigid panels which interactively define an interior holding zone carefully dimensioned to maintain the panels in spaced apart relationship. A thin transparent retainer is utilized to secure flat objects, such as postage stamps, and the retainer is inserted into the holding zone. The edges of the case are then permanently bonded in an inert atmosphere to ensure archival storage of the thus encased object. A very important concept of the Hager display case is that the panels of the case do not squeeze down upon the retainer. The Hager case is of significant weight, and is intended for one-time use. Encasement of a collectible object within the Hager case requires specialized equipment.

Despite the numerous prior art disclosures of framing holders for displaying flat objects, certain desirable needs remain unfulfilled.

It is accordingly an object of the present invention to provide a re-usable plastic holder for protectively displaying visually distinctive flat objects.

It is another object of this invention to provide a holder as in the foregoing object which rapidly and removably accommodates a flat object.

It is a further object of the invention to provide a holder of the aforesaid nature wherein a single insertive movement of the flat object achieves framing and securement within the holder.

It is yet another object of this invention to provide a holder of the aforesaid nature of sufficiently low weight to be pendently supported as a Christmas tree ornament.

It is a still further object of the present invention to provide a holder of the aforesaid nature of simple construction amenable to low cost manufacture.

These and other beneficial objects and advantages will be apparent from the following description.

SUMMARY OF THE INVENTION

The above and other beneficial objects and advantages are accomplished in accordance with the present invention by a holder comprised of:

a) a jacket formed from two identical sheets of semi-rigid non-breakable transparent plastic bounded by four straight edges in a rectangular configuration elongated upon a center axis, said sheets disposed one atop the other and sealed together along three edges by bonding to intervening transparent plastic spacer strips of uniform thickness disposed contiguously with said edges and parallel thereto, whereby the unsealed fourth edges define an entrance opening to an enclosure bounded by said sheets and spacer strips, said sheets being bowed into contact upon said axis, and b) a pouch-like retainer member comprised of front and rear panels of compliant thin sheet material of rectangular outer contour disposed one atop the other and hingedly joined at one edge considered a lower edge, said front panel having an aperture centered upon said axis, said retainer member dimensioned such as to slidably insert through said opening and fill said enclosure.

In a preferred embodiment, the rectangular configuration of the jacket and retainer member is such as to have two opposed long sides and two opposed short sides. In such configuration, the lower edges of the retainer member, where hinged joinder occurs, are preferably at the short sides of the rectangle.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
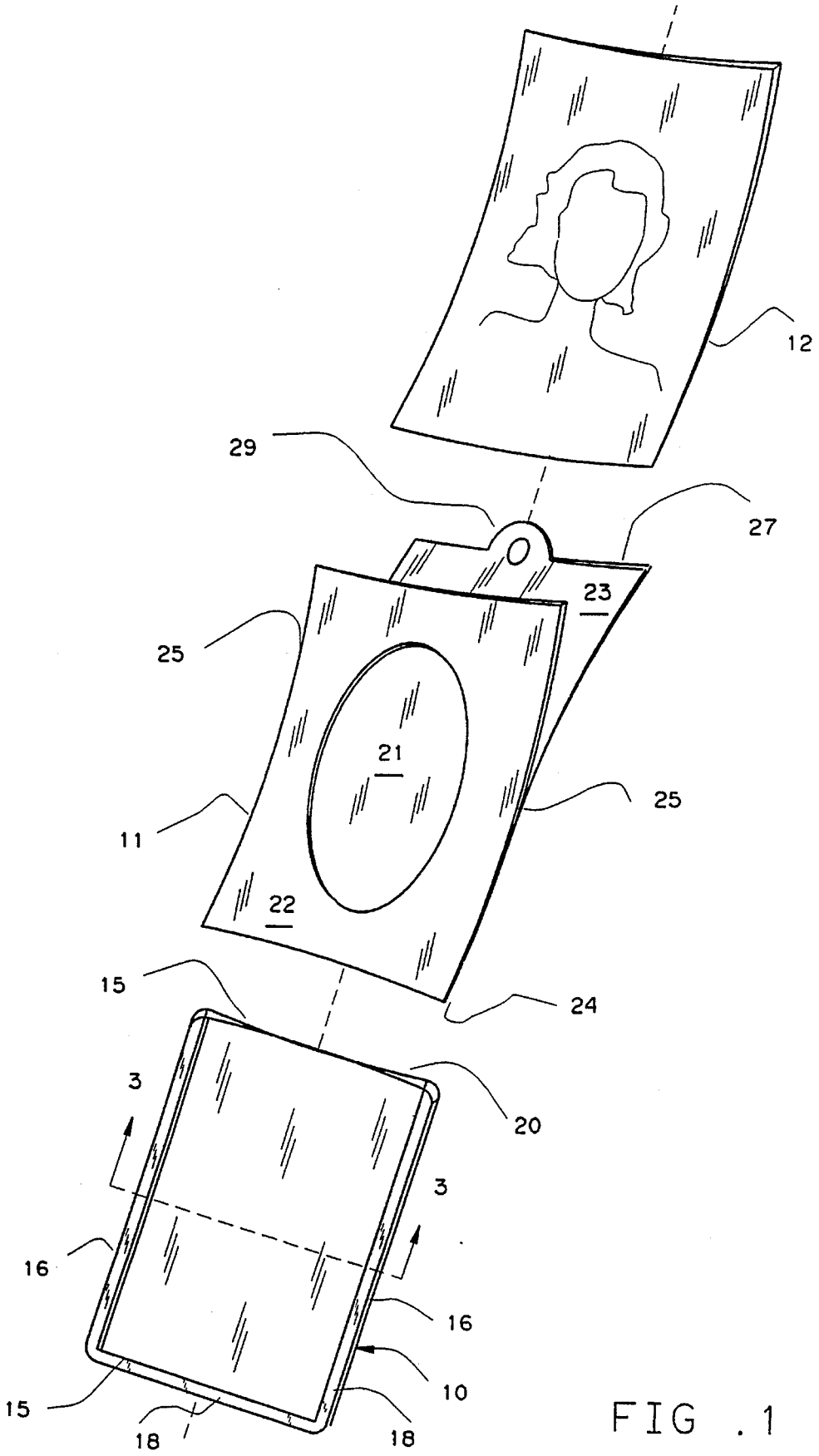
FIG. 1 is an exploded front and top perspective view of an embodiment of the holder of this invention.
Figure 2:
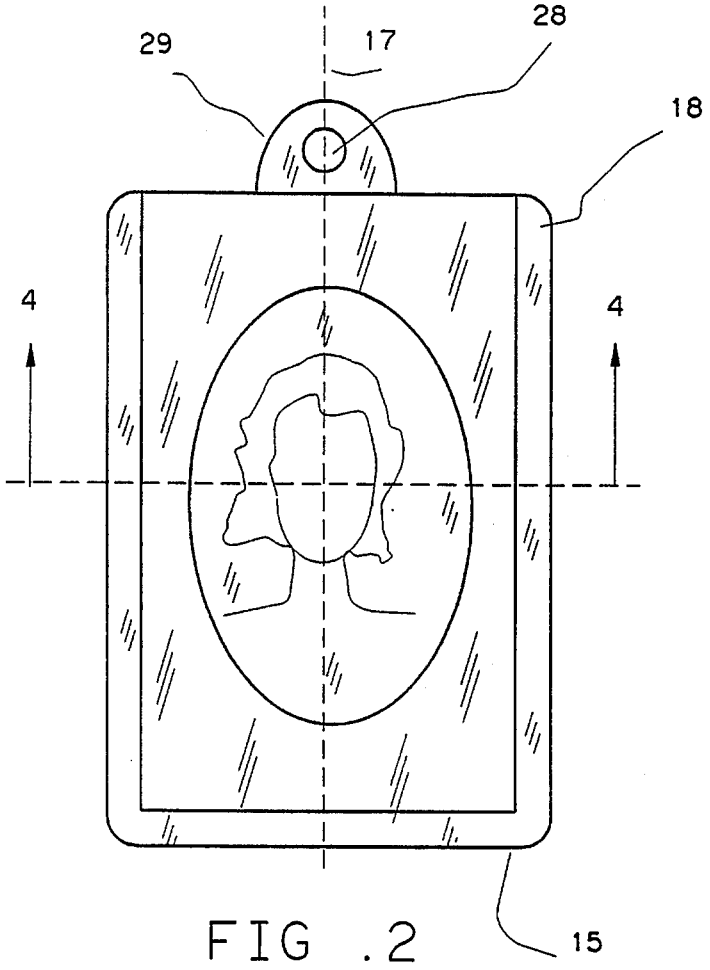
FIG. 2 is a front view of the holder of FIG. 1 shown holding a photograph.

Referring to FIGS. 1–4, an embodiment of the holder of the present invention is shown comprised of jacket 10 and retainer member 11 adapted to slidably fit into said jacket. A photograph 12 is shown in association with the holder.

Jacket 10 is formed from identical front and rear sheets 13 and 14, respectively, fabricated of semi-rigid non-breakable transparent plastic. Suitable plastics include plasticized polyvinyl chloride, polycarbonate, polyacrylic esters, and ionomer resins. Said sheets are of elongated rectangular configuration, bounded by opposed short edges 15 and long edges 16, and having a center axis 17 parallel to said long edges and midway therebetween. Said sheets are disposed one atop the other and sealed together by bonding to intervening transparent plastic spacer strips 18 spaced in contiguous relationship to three of said edges. Said spacer strips are of uniform thickness, measured in the direction orthogonal to said sheets, and are of uniform width, measured in the plane of said sheets. The sheets will typically have a uniform thickness in the range of about 0.1 to 0.8 millimeter.

The sealed sheets define an enclosure 19 bounded by said sheets and spacer strips. The unsealed fourth edges of said sheets define an entrance opening 20 providing access to enclosure 19. The thickness of the spacer strips is between about 0.2 mm and 1.0 mm. The sealing of the sheets to the spacer strips may be achieved by adhesives or cohesive bonding techniques which include ultrasonic welding, microwave heating and the use of heated platens and rollers.

Sheets 13 and 14 are bowed inwardly toward enclosure 19, and contact each other upon axis 17. The force required to restore said sheets outwardly to a parallel configuration, which may be referred to as the contact force of said sheets, is between 20 and 80 grams per linear inch of contact along said axis. As will be shown hereinafter, said contact force secures retainer member 11 within said jacket. It has been found that force values below 20 grams/inch are inadequate to properly secure said retainer member. Force values above 80 grams/inch cause difficulties in flexing sheets 13 and 14 apart to permit insertion of the retainer member into the jacket. The magnitude of the intercontactive force between sheets 13 and 14 is controlled during the process of fabricating the jacket, particularly during the step of bonding the sheets to spacer strips 18. The intercontactive force also serves the further purpose of preventing movement of the flat object within the retainer member. Accordingly, no adhesives are needed to position the flat object within the retainer member.

Figure 4:
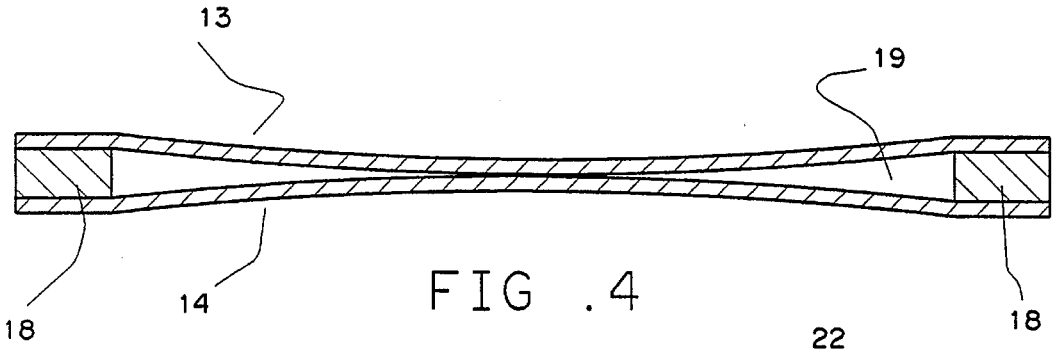
FIG. 4 is a greatly enlarged sectional view taken in the direction of the arrows upon the line 4—4 of FIG. 2.
Figure 3:
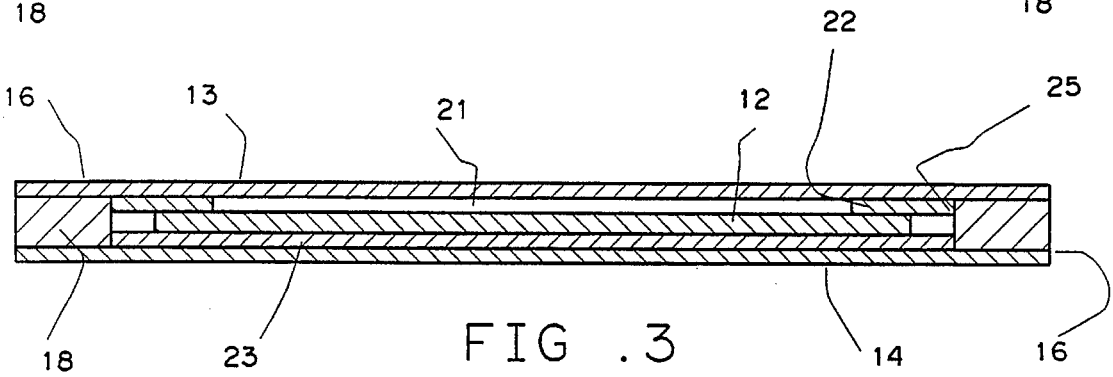
FIG. 3 is a greatly enlarged sectional view taken in the direction of the arrows upon the line 3—3 of FIG. 1.

Retainer member 11 is of pouch-like or stamp hinge type of construction comprised of front and rear panels 22 and 23, respectively, fabricated of compliant thin sheet material disposed one atop the other. Panels 22 and 23 have a rectangular outer contour and are hingedly joined at one edge, considered a lower edge 24. The panels may be separate pieces, or may be a single piece folded upon itself to provide two panel portions. Where separate pieces are employed, they may be of different visual appearance in terms of color, texture, or surface indicia or ornamentation. Front panel 22 is provided with an aperture 21 having an axis of elongation superimposed upon axis 17. Said retainer member is dimensioned such that it may be slidably inserted through opening 20, so that its bottom or hinged edge 24 will come to resting abutment with the spacer strip 18 opposite said opening. The width of the retainer panels is such that the lateral edges 25 of said panels rest against or closely adjacent opposed spacer strips 18 of jacket 10. It is to be noted, especially as shown in FIG. 4, that the front surface of the flat object 12 exposed through aperture 21 is spaced apart from sheet 13 of the jacket. Such configuration not only prevents scratching of the photograph upon insertion into the jacket, but enhances archival survivability.

In use, a flat object 12 such as a photograph is inserted into the separated panels of the retainer member, and said retainer member is pushed through the opening of jacket 10 until the short edges, such as bottom edge 25 achieves abutment with spacer strip 18 opposite opening 20.

In the illustrated embodiment, rear panel 23 of the retainer member is provided with a holding tab 29 emergent from the upper edge 27 of said panel as a continuous integral extension thereof. Such tab facilitates removal of retainer member 11 from jacket 10. A mounting hole 28 is located within said tab for the purpose of engaging a string or other securing means. By virtue of the strong frictional force that maintains the retainer within the jacket, and the low overall weight of the holder device, the holder device containing a flat object can be pendently suspended via tab 26. In such manner, the holder is particularly well suited for use as a Christmas tree ornament.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A self-framing holder for protectively displaying flat objects, said holder comprising:

a) a jacket formed from two identical sheets of semi-rigid transparent plastic bounded by four straight edges in a rectangular configuration elongated upon a center axis, said sheets disposed one atop the other and sealed together along three edges by bonding to intervening plastic spacer strips of uniform thickness disposed contiguously with said three edges and parallel thereto, whereby unsealed fourth edges define an entrance opening to an enclosure bounded by said sheets and spacer strips, said sheets being bowed into contact with one another upon said axis, and b) a pouch-like retainer member comprised of front and rear panels of compliant thin sheet material of rectangular outer contour disposed one atop the other and hingedly joined at one edge considered a lower edge, said front panel having an aperture centered upon said axis, said retainer member dimensioned such as to slidably insert through said opening and fill said enclosure.

2. The holder of claim 1 wherein the rectangular configuration of said jacket and retainer member is such as to have two opposed long sides and two opposed short sides.

3. The holder of claim 2 wherein the lower edge of the retainer member, where hinged joinder occurs, are said short sides of said rectangular configuration.

4. The holder of claim 3 wherein the aperture of said front panel has an axis of elongation which is superimposed upon the center axis of said jacket.

5. The holder of claim 4 wherein edges of said panels opposite to the edges which are hingedly joined are considered upper edges.

6. The holder of claim 5 wherein a holding tab is upwardly emergent from the upper edge of at least one of said panels as a continuous integral extension of said panel.

7. The holder of claim 6 wherein said holding tab contains a mounting hole.

8. The holder of claim 6 wherein the weights of the jacket and retainer member, and the contact force between said sheets are selected such that the holder can be suspended by said tab without causing separation of said retainer member from said jacket.

9. The holder of claim 1 wherein said sheets are bowed into contact upon said axis with a force of between 20 and 80 grams per linear inch of contact.

10. The holder of claim 1 wherein said spacer strips are transparent.

* * * * *